US006363557B2

(12) United States Patent
Chou

(10) Patent No.: US 6,363,557 B2
(45) Date of Patent: Apr. 2, 2002

(54) ADJUSTABLE PILLOW

(76) Inventor: Chao-Mu Chou, 4F, No. 14, Alley 11, Lane 123, Sec. 3, Jen Ai Road, Taipei (TW)

( * ) Notice: Subject to any disclaimer, the term of this patent is extended or adjusted under 35 U.S.C. 154(b) by 0 days.

(21) Appl. No.: 09/725,304

(22) Filed: Nov. 29, 2000

(30) Foreign Application Priority Data

Dec. 14, 1999 (TW) ..... 88221225 U

(51) Int. Cl.[7] ..... A47G 9/10
(52) U.S. Cl. ..... 5/645; 5/636; 5/640
(58) Field of Search ..... 5/636, 640, 644, 5/645, 702, 655.4, 657, 911, 738

(56) References Cited

U.S. PATENT DOCUMENTS 853,049 A * 5/1907 Weston ..... 5/738
1,206,775 A * 11/1916 Everts ..... 5/645
4,780,921 A * 11/1988 Lahn et al. ..... 5/636
4,949,411 A * 8/1990 Tesch ..... 5/645
4,969,223 A * 11/1990 Yamaguchi ..... 5/738
5,644,810 A * 7/1997 Kato ..... 5/645
5,809,594 A * 9/1998 Isogai ..... 5/645

* cited by examiner

*Primary Examiner*—Michael F. Trettel
(74) *Attorney, Agent, or Firm*—Troxell Law Office PLLC

(57) ABSTRACT

An adjustable pillow includes a bag body formed from a fabric material and including a closure device for closing and opening the bag body, the bag body being internally provided with more than one partitioning piece to define two or more chambers; and linings in units of one or more than two and sized to correspond to the chambers so as to be selectively disposed in the chambers.

8 Claims, 2 Drawing Sheets

ADJUSTABLE PILLOW

BACKGROUND OF THE INVENTION

1. Field of the Invention

The present invention relates to a pillow, and particularly to an adjustable pillow.

2. Description of Related Art

Pillows are indispensable items in our daily life. The quality of a pillow may affect the quality of sleep, and is therefore very important. In a broad sense, pillows include bolsters, cushions and the like. The definition of a "good" pillow may vary according to the users' sleeping habits and preference. The factors generally affecting the quality of a pillow include the softness, height and shape of the pillow. For purposes of hygiene, pillows should also be washable to prevent breeding of mites or the like.

With the rise of living standards, consumers have become more demanding in terms of the quality of pillows. Manufacturers have spent efforts to improve the material or the effects of the pillows. Therefore, there are now a wide variety of pillows for consumers' choices.

The applicant has filed a patent application with the U.S. Patent & Trademark Office directed to a pillow, and has been granted a U.S. Pat. No. 5,920,933. This invention is an effort to further improve existing pillows.

SUMMARY OF THE INVENTION

The object of the invention is to provide an adjustable pillow that is intended to enable consumers to select and adjust the hardness or softness of linings of the pillow, other than the height of the pillow.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENTS

Figure 1:
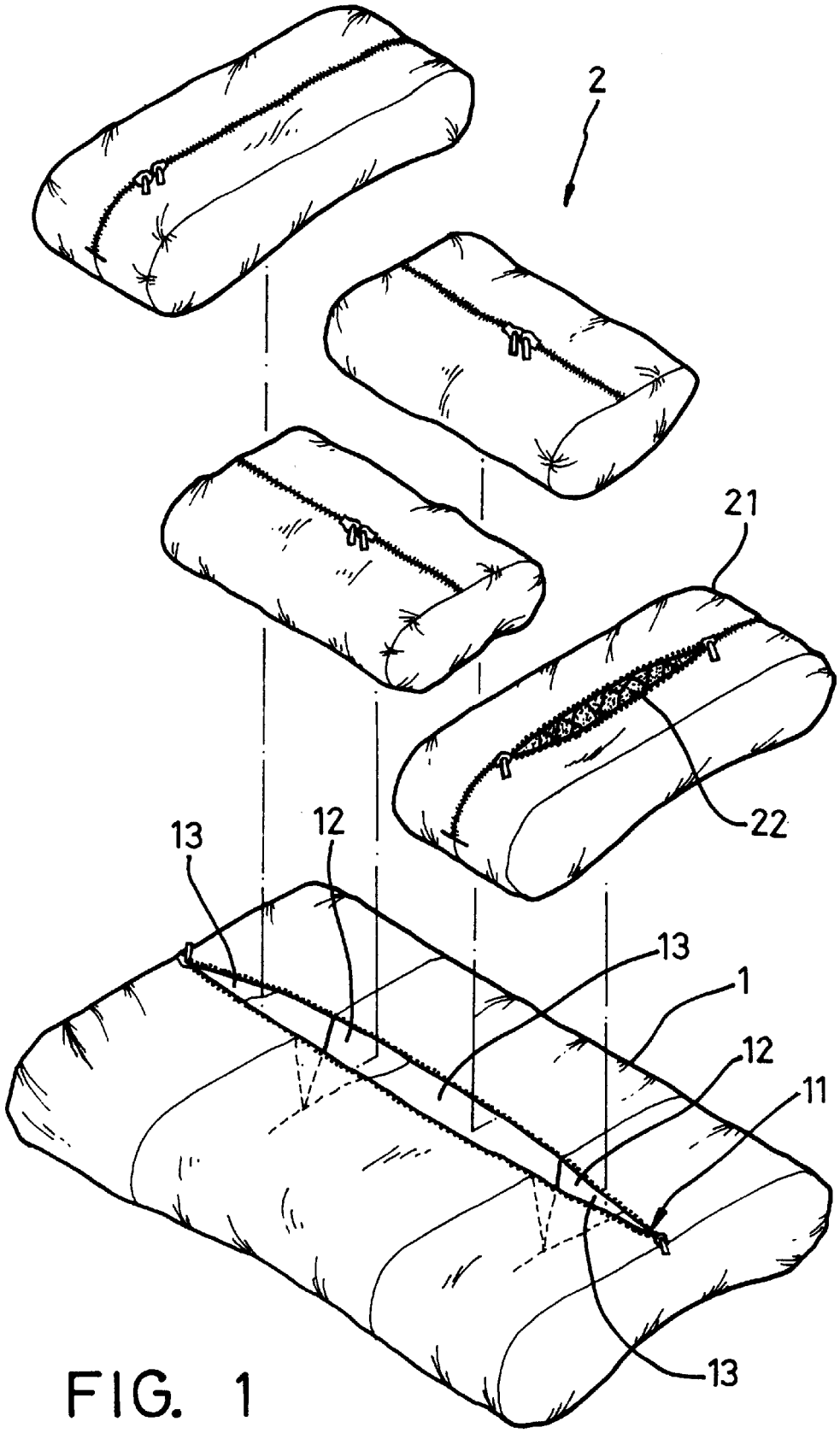
FIG. 1 is an exploded perspective view of the present invention.
Figure 2:
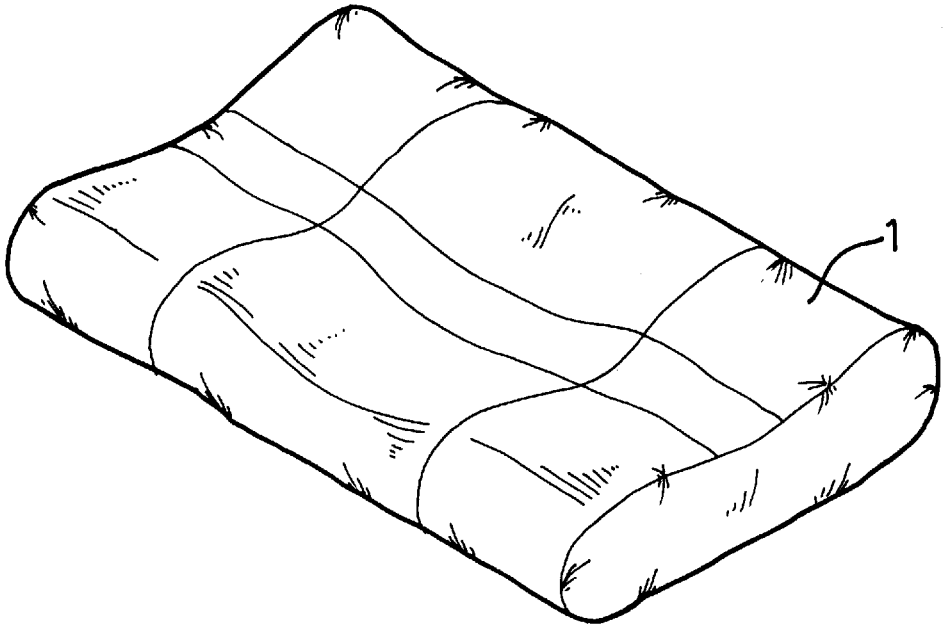
FIG. 2 is a schematic perspective view of the present invention after assembly.

As shown in the accompanying FIGS. 1 through 2, the preferred embodiment of an adjustable pillow according to the invention includes a bag body 1 and a plurality of linings 2.

The bag body 1 is made from a fabric material and defines an enclosed space after being closed. The bag member 1 includes a closure device 11 which can be provided on one side or a lateral edge of the bag member 1, and may be in the form of loop-and-hook fasteners, buttons, or zipper, etc. In this embodiment, the closure device 11 is a zipper.

The interior of the bag body 1, for purposes of adjustment, includes at least one partitioning piece 12 to divide the interior of the bag body 1 into two or more chambers 13. The partitioning piece 12 may be sewn to the interior of the bag body 1 in a known manner by turning the bag body 1 inside out first and then turning the bag body 1 in a reverse manner after sewing. In this embodiment, there are provided two partitioning pieces 12 to define three chambers 13.

The linings 2 are provided to match the chambers 13. To provide an adjustment function, the size of the lining 2 may be modularized, and may be a large unit corresponding to the size of the chamber 13 or a small unit of a smaller size. For an assembly of two or more small units, the size should correspond to that of the chamber 13. In this embodiment, one or two linings 2 corresponding to one chamber 13. That is, the size of the lining 2 is equal to or is half of that of the chamber 13.

As mentioned above, the object of the invention is to provide an adjustment function so as to meet consumers' requirements. Therefore, the lining 2 is made of a soft material, and may be cut from foamed rubber, sponge, etc., or in the form of a lining sac 21 with a lining material 22 disposed inside. The lining material 22 may be high-polymer beads, mung beans shells, sponge pieces, scraps of cloth. The lining 2 may be completely closed or provided with a closure member, such as a zipper, hook-and-loop fasteners, etc., to permit access of the lining material 22.

Referring to the FIGS. 1 and 2, in practice, the user may selectively put the linings 2 into the chambers 13 according to his sleeping habits. In this embodiment, the lining sacs 21 are placed inside the bag body 1 such that the two lateral portions and the rear central portion of the pillow are relatively high while the front central portion is relatively low, thereby creating a drop. In addition, the closure member 11 is disposed at the bottom side. As such, a pillow is achieved. Furthermore, through the selection of different materials for the linings 2, pillows according to the present invention can meet the demands of different users.

When washing of the pillow is desired, the linings 2 can be removed via the closure member 11. Even the lining material 22 can be removed from the linings 2. Hygiene is therefore ensured.

Figure 3:
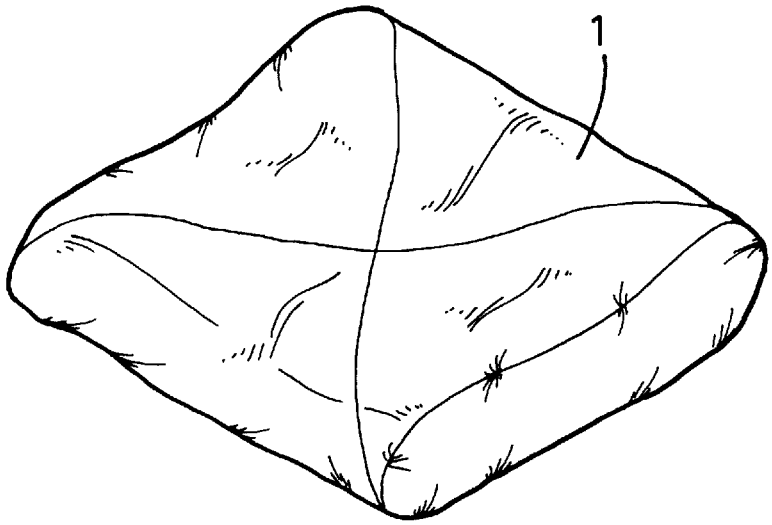
FIG. 3 is a schematic view of another preferred embodiment of the present invention.

With reference to FIG. 3, which shows another preferred embodiment of this invention, the bag body 1 is provided with a plurality of partitioning pieces 12 extending radially outward from the center to form chambers 13 resembling fans, and the linings 2 are also of a similar shape. The closure member 11 is provided at the edge portion. Therefore, through selection of the material of linings 2, a pillow having different materials and different degrees of softness can be achieved to meet different users' demands.

In view of the aforesaid, the pillow of the present invention not only is washable to ensure hygiene, it is provided with linings that can be selected and arranged by the user to provide flexible use.

Although the present invention has been illustrated and described with reference to the preferred embodiment thereof, it should be understood that it is in no way limited to the details of such embodiment but is capable of numerous modifications within the scope of the appended claims.

What is claimed is:

1. An adjustable pillow, comprising:

a) a bag body formed from a fabric material and including a closure device for closing and opening the bag body, the bag body being internally provided with a plurality of partitioning pieces to define at least two chambers, the partitioning pieces extending radially outwardly from a center of the bag body; and, b) at least one lining unit removably located within at least one of the chambers of the bag body, the at least one lining unit sized corresponding to the at least one chamber.

2. The adjustable pillow of claim 1 wherein the at least one lining unit comprises a lining sac containing a lining material.

3. The adjustable pillow of claim 2 further comprising a closure member provided on the lining sac.

4. The adjustable pillow of claim 3 wherein the closure member comprises a zipper.

5. The adjustable pillow of claim 1 wherein the closure device comprises a zipper.

6. An adjustable pillow comprising:

a) a bag body formed from a fabric material and having an upper surface, a lower surface and a plurality of side surfaces bounding an interior, the lower surface having an opening to provide access to the interior;

b) a closure device on the lower surface of the bag body so as to open and close the opening in the lower surface;

c) at least one partition attached to the upper and lower surfaces and located in the interior of the bag body so as to divide the interior into a plurality of chambers; and, d) at least one lining unit removably located in at least one of the plurality of chambers, the at least one lining unit being insertable into and removable from the chamber through the opening in the lower surface of the bag body, the at least one lining unit comprising a lining sac containing a lining material and a closure member provided on the lining sac.

7. The adjustable pillow of claim 6 wherein the closure member comprises a zipper.

8. The adjustable pillow of claim 6 wherein the closure device comprises a zipper.

* * * * *